US008870365B2

(12) United States Patent
Vandagriff et al.

(10) Patent No.: US 8,870,365 B2
(45) Date of Patent: Oct. 28, 2014

(54) VACUUM PULLDOWN OF A PRINT MEDIA IN A PRINTING SYSTEM

(75) Inventors: Randy D. Vandagriff, Xenia, OH (US); Michael J. Piatt, Dayton, OH (US); Harsha S. Bulathsinghalage, Miamisburg, OH (US); W. Charles Kasiske, Jr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 145 days.

(21) Appl. No.: 13/483,368

(22) Filed: May 30, 2012

(65) Prior Publication Data

US 2013/0321545 A1 Dec. 5, 2013

(51) Int. Cl.
*B41J 2/01* (2006.01)

(52) U.S. Cl.
USPC ..... 347/104

(58) Field of Classification Search
CPC ..... B41J 2/01
USPC ..... 347/104
See application file for complete search history.

(56) References Cited

U.S. PATENT DOCUMENTS

| | | | | |
|---|---|---|---|---|
| 3,837,551 | A | 9/1974 | Schregenberger | |
| 2004/0001132 | A1 | 1/2004 | Bruhn et al. | |
| 2008/0218576 | A1 * | 9/2008 | Phillips et al. | 347/104 |
| 2010/0171782 | A1 * | 7/2010 | Kado et al. | 347/16 |
| 2010/0220167 | A1 | 9/2010 | Nagata | |

FOREIGN PATENT DOCUMENTS

| | | |
|---|---|---|
| EP | 2 179 852 | 4/2010 |

* cited by examiner

*Primary Examiner* — Alessandro Amari
*Assistant Examiner* — Alexander C Witkowski
(74) *Attorney, Agent, or Firm* — Nancy R. Simon; Amit Singhad

(57) ABSTRACT

A printing system includes one or more lineheads disposed opposite a first side of a print media and at least one vacuum assembly having a vacuum manifold disposed opposite a second side of the print media. The linehead or lineheads has one or more print zones where a liquid or ink is deposited onto the first side of the print media. The vacuum manifold is aligned with a non-print zone of each linehead and outputs a vacuum force proximate to the second side of the print media such that at least a portion of the second side of the print media is deflected away from the lineheads. The printing system can also include another component, such as a dryer, disposed over the print media and laterally adjacent to the linehead. Another vacuum manifold can be disposed adjacent to the second side print media between the linehead and the component.

7 Claims, 12 Drawing Sheets

VACUUM PULLDOWN OF A PRINT MEDIA IN A PRINTING SYSTEM

CROSS REFERENCE TO RELATED APPLICATIONS

Reference is made to commonly-assigned, U.S. patent application Ser. No. 13/483,356, entitled "VACUUM PULLDOWN OF A PRINT MEDIA IN A PRINTING SYSTEM", filed concurrently herewith.

TECHNICAL FIELD

The invention relates generally to the field of digitally controlled printing systems, and more particularly to transporting a print media through a printing system. Still more particularly, the present invention relates to the use of a vacuum pulldown of the print media as the print media is transported through the printing system.

BACKGROUND

In a digitally controlled printing system, such as an inkjet printing system, a print media is directed through a series of components. The print media can be a cut sheet or a continuous web. A web or cut sheet transport system physically moves the print media through the printing system. As the print media moves through the printing system, liquid, for example, ink, is applied to the print media by one or more printheads through a process commonly referred to a jetting of the liquid. The jetting of liquid onto the print media introduces significant moisture content to the print media, particularly when the system is used to print multiple colors on a print media. Due to its moisture content, the print media expands and contracts in a non-isotropic manner often with significant hysteresis. The continual change of dimensional characteristics of the print media often adversely affects image quality. Although drying is used to remove moisture from the print media, drying too frequently, for example, after printing each color, also causes changes in the dimensional characteristics of the print media that often adversely affects image quality.

FIG. 1 illustrates a portion of the print media as the print media passes over two rollers that support the print media under each row of printheads in accordance with the prior art. During an inkjet printing process, the print media can expand as the print media absorbs the water-based inks applied to it. When the direction of expansion is in a direction that is perpendicular to the direction of media travel 100, it is often referred to as expansion in the crosstrack direction 102. Typically, the wrap of the print media around a roller of an inkjet printing system produces sufficient friction between the print media and the roller that the print media is not free to slide in the crosstrack direction even though the print media is expanding in that direction. This can result in localized buckling of the print media away from the roller to create lengthwise ripples, also called flutes or wrinkles, in the print media. Flutes or ridges 104, 106 can be produced in the print media due to expansion of the print media in the crosstrack direction 102 because the print media cannot slip on the rollers 108, 110. Wrinkling of the print media during the printing process often leads to permanent creases forming in the print media that ultimately affect image quality.

Multiple printheads are typically located and aligned by a support structure to form a linehead, with the linehead located over the print media. In many such systems, the support structure of the linehead locates the printheads in two or more rows; the rows being parallel to each other and aligned in the crosstrack direction. To prevent the print media from fluttering, or vibrating up and down in the print zone, the print media is supported by a roller that is aligned with the print line of each row of printheads. It is not uncommon for the bottom face of the support structure to become wet, either due to condensation from the moist air produced by the printing process or due to mist drops created by the print drops striking the print media.

It has been found that under some printing conditions the flutes in the print media can be sufficiently tall that top of the flutes can contact the bottom face of the support structure. When this occurs, the moist ink on the flutes can be smeared by the contact. Additionally, the moisture on the bottom of the support structure can be transferred to the print media. The result is a degradation of the print quality.

SUMMARY

According to one aspect, a printing system includes one or more lineheads disposed opposite a first side of a print media and at least one vacuum assembly having a vacuum manifold disposed opposite a second side of the print media. The linehead or lineheads has one or more print zones where a liquid or ink is deposited onto the first side of the print media. The vacuum manifold is aligned with a non-print zone of each linehead and outputs a vacuum force proximate to the second side of the print media such that at least a portion of the second side of the print media is deflected away from the lineheads.

According to another aspect, the printing system can also include another component, such as a dryer, disposed over or opposite the first side of the print media and laterally adjacent to a linehead. Another vacuum manifold can be disposed under or opposite the second side of the print media between the linehead and the component. The vacuum manifold can be included within a second vacuum assembly.

According to another aspect, the vacuum assembly can include an adjustment structure to adjust the effective width of the vacuum manifold.

According to another aspect, a printing system can include one or more lineheads with each linehead having one or more print zones that deposit a liquid or ink on a first side of the print media and a vacuum assembly having a vacuum manifold disposed opposite a second side of the print media opposite at least one linehead. The vacuum manifold of the vacuum assembly is aligned with a non-print zone of the at least one linehead. A method for printing on the print media includes moving the print media through the printing system and applying a vacuum force proximate to the second side of the print media opposite the at least one linehead based on particular print job characteristics. The print job characteristics can include, but are not limited to, a weight of the moving print media and a content density of the content to be printed on the moving print media.

BRIEF DESCRIPTION OF THE DRAWINGS

In the detailed description of the example embodiments of the invention presented below, reference is made to the accompanying drawings, in which.

DETAILED DESCRIPTION

Figure 1:
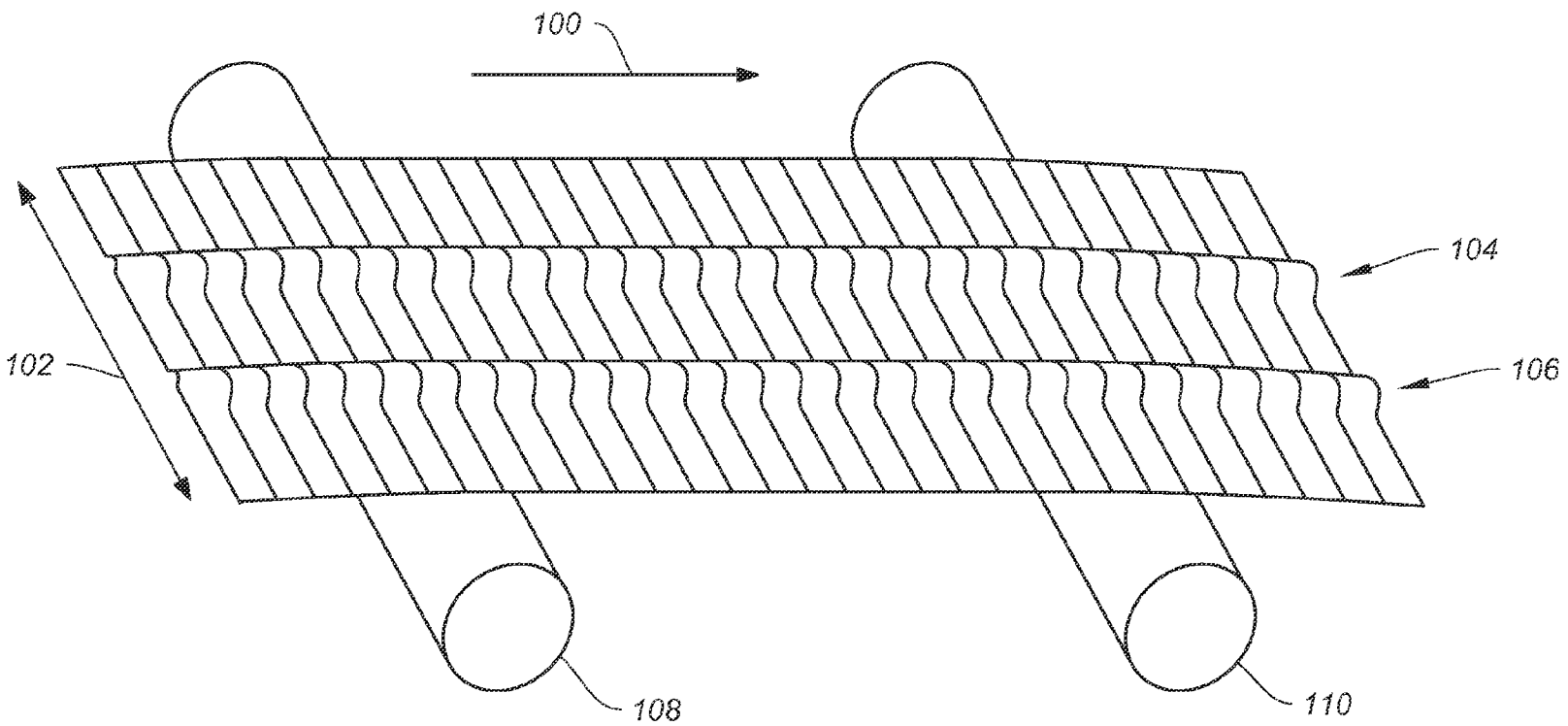
FIG. 1 illustrates a portion of the print media as the print media passes over two rollers that support the print media under each row of printheads in accordance with the prior art.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. Other non-ink liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

The invention described herein is applicable to both types of printing technologies. As such, the terms printhead, linehead, and nozzle array, as used herein, are intended to be generic and not specific to either technology.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

Embodiments of the present invention are described herein with respect to an inkjet printing system. However, the term "printing system" is intended to be generic and not specific to inkjet printing systems. The invention is applicable to other types of printing systems, such as offset or traditional printing press technologies that print on a print media as the print media passes through the printing system.

The terms "upstream" and "downstream" are terms of art referring to relative positions along the transport path of the print media; points on the transport path move from upstream to downstream. In FIGS. 2-5 and 14 the print media moves from in a direction indicated by feed direction arrow 214. Where they are used, terms such as "first", "second", and so on, do not necessarily denote any ordinal or priority relation, but are simply used to more clearly distinguish one element from another.

Figure 2:
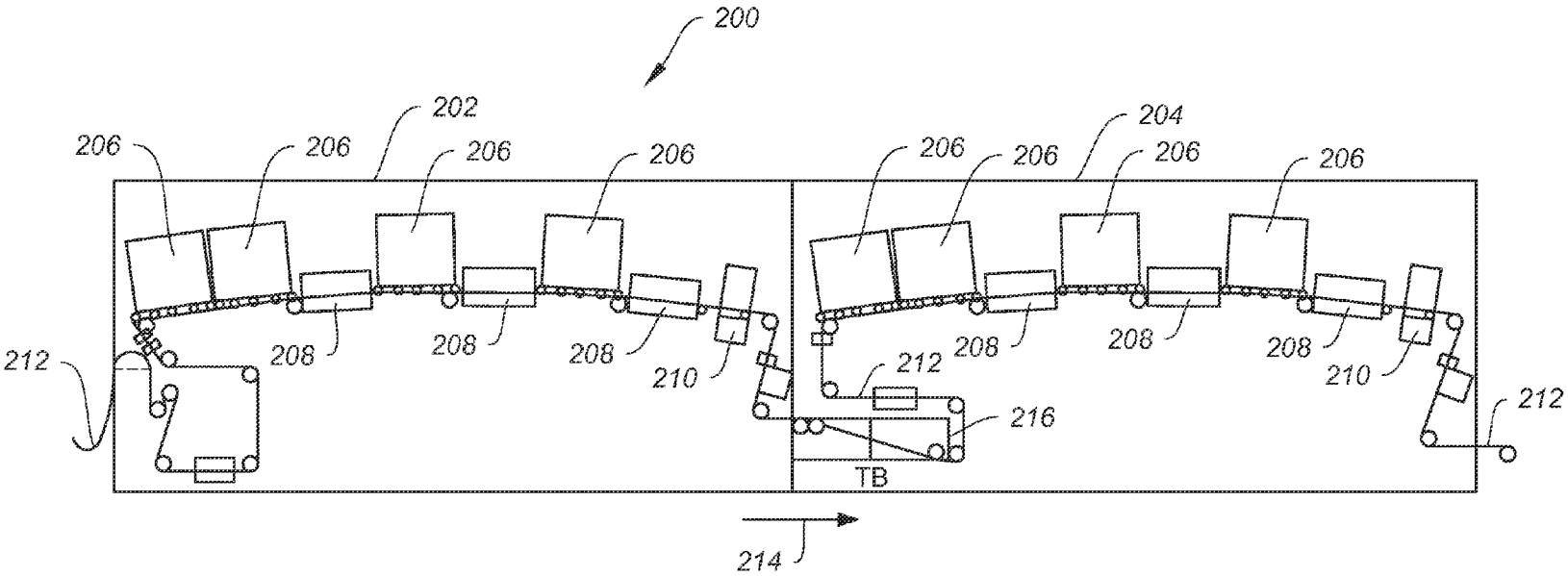
FIG. 2 is a schematic side view of a printing system for continuous web printing on a print media in an embodiment in accordance with the invention.

Referring now to FIG. 2, there is shown a printing system for continuous web printing on a print media in an embodiment in accordance with the invention. The print media is continuous as the print media passes through the printing system. The printing system 200 includes a first module 202 and a second module 204, each of which includes lineheads 206, dryers 208, and a quality control sensor 210. The lineheads 206, dryers 208, and quality control sensors 210 are positioned opposite a first side of the print media 212. In addition, the first module 202 and the second module 204 include a web tension system (not shown) that serves to physically move the print media 212 through the printing system 200 in the feed direction 214 (left to right in the figure).

The print media 212 enters the first module 202 from a source roll (not shown). The print media 212 is supported and guided through the printing system by rollers (not shown) without the need for a transport belt to guide and move the print media through the printing system. The linehead(s) 206 of the first module applies ink to the first side of the print media 212. As the print media 212 feeds into the second module 204, there is a turnover mechanism 216 which inverts the print media 212 so that linehead(s) 206 of the second module 204 can apply ink to the second side of the print media 212. The print media 212 then exits the second module 204 and is collected by a print media receiving unit (not shown).

Figure 3:
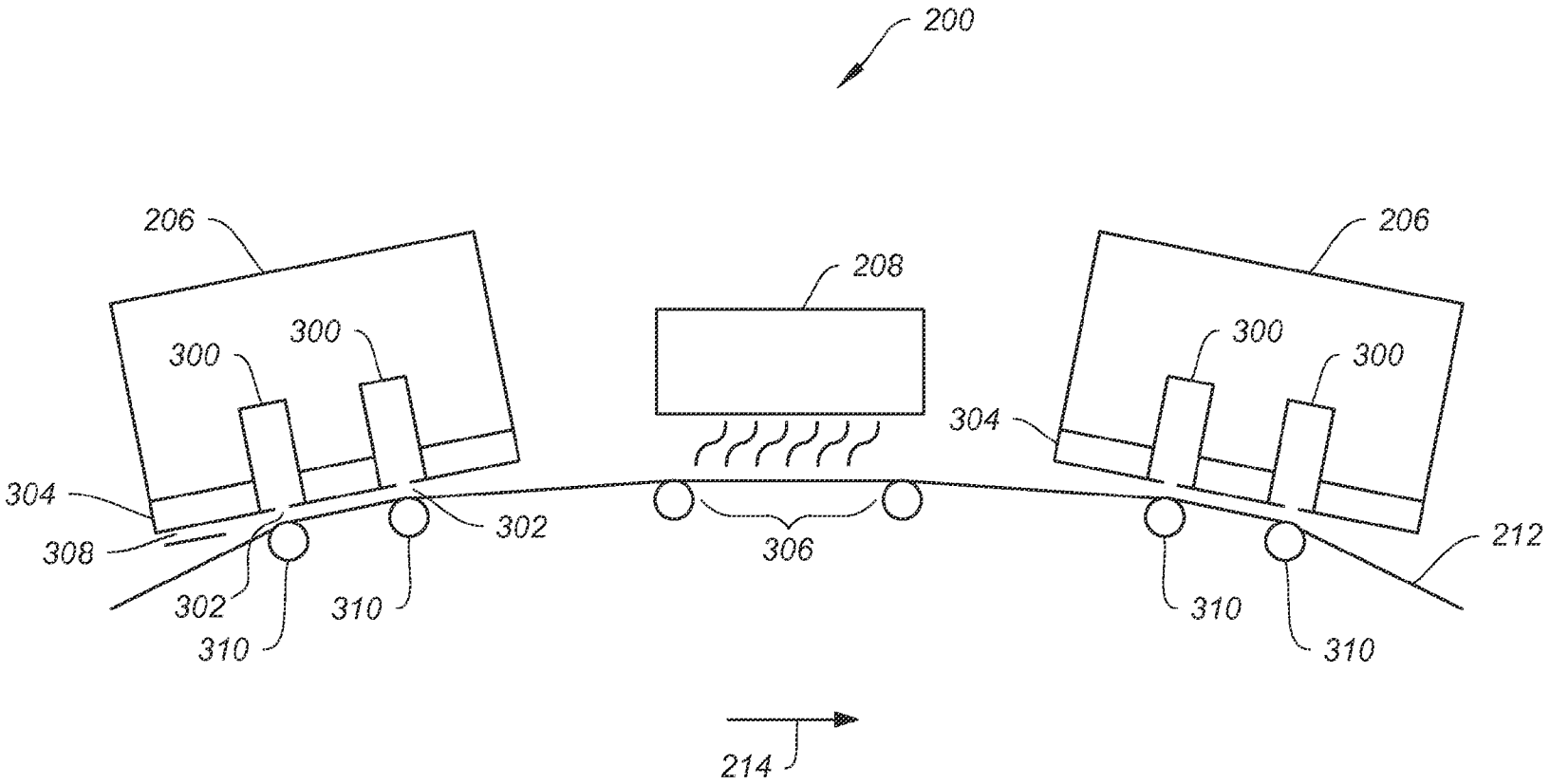
FIG. 3 depicts a portion of the printing system 200 shown in FIG. 2 in more detail.

FIG. 3 depicts a portion of the printing system 200 in more detail. As the print media 212 is directed through the printing system 200, the lineheads 206, which typically include printheads 300, apply ink or another liquid via the nozzle arrays 302 of the printheads 300. The printheads 300 within each linehead 206 are located and aligned by a support structure 304. After the ink is jetted onto the print media 212, the print media 212 passes beneath the dryer 208, which applies heat 306 to the print media to dry the ink.

As the ink applied to the print media 212 dries by evaporation, the humidity of the air above the print media 212 rises in the clearance gap 308 between the printer components (for example, lineheads 206 and dryers 208) and the print media 212. To prevent the print media that is opposite the lineheads 206 from fluttering and contacting the support structure 304, the print media 212 is supported by rollers 310 that are aligned with a print line of each row of printheads.

Figure 4:
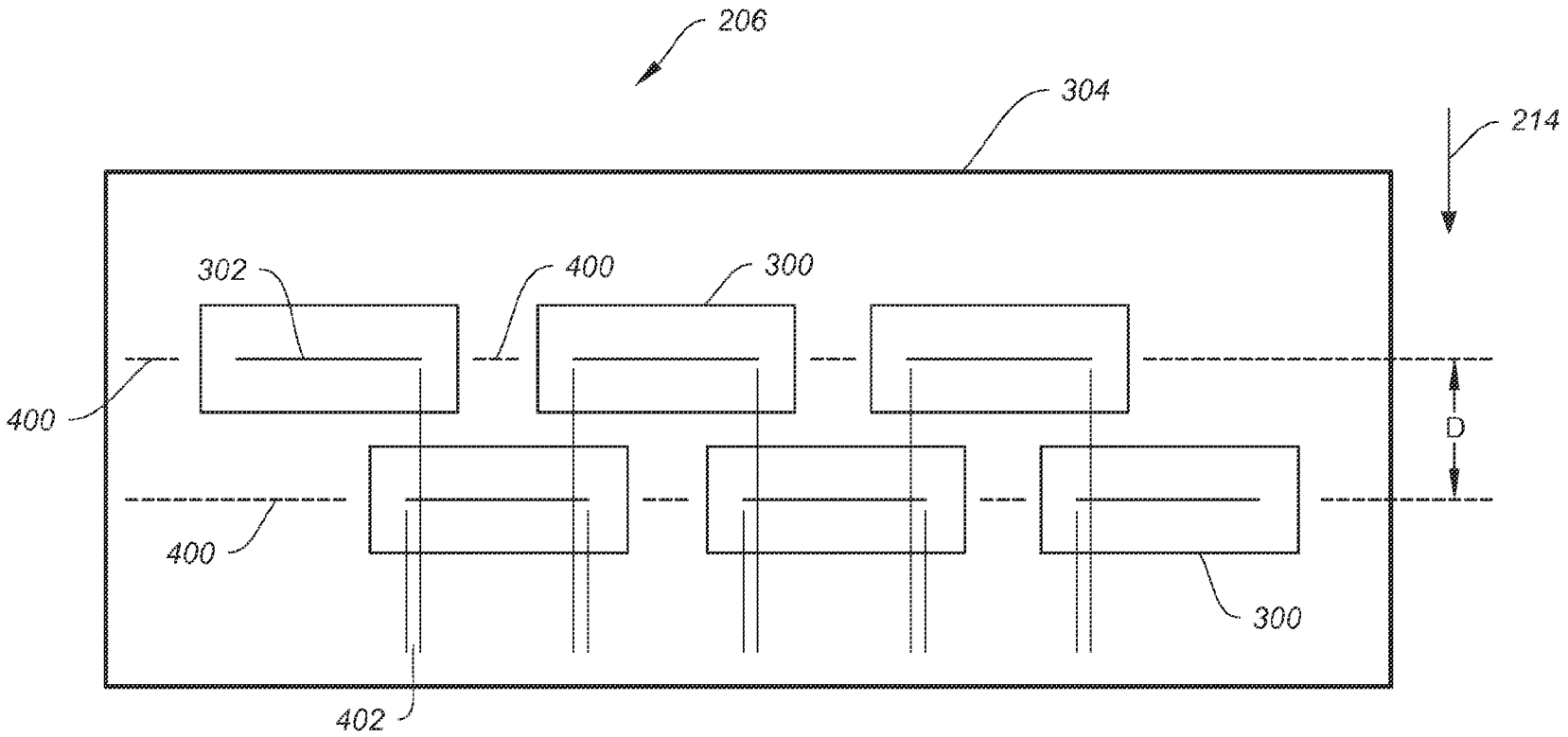
FIG. 4 illustrates an example of an arrangement of the printheads in a linehead in an embodiment in accordance with the invention.

Referring now to FIG. 4, there is shown an example of an arrangement of printheads 300 in a linehead 206 in an embodiment in accordance with the invention. A face of the support structure 304 that is adjacent to the print media 212 is shown. The printheads 300 are aligned in two or more rows in a staggered formation. The nozzles arrays 302 of the printheads in each row rows of printheads 300 lie along a line, called a print line 400, which is parallel to the crosstrack direction and perpendicular to the direction of motion of the print media denoted by the arrow 214. The nozzle array 302 of each printhead is also aligned along the crosstrack direction. The print lines 400 for the rows of nozzle arrays 302 are spaced apart by a distance D. The ends of the nozzle arrays 302 of the printheads in one row overlap with the ends of the nozzles arrays of printheads in the other row or rows to produce overlap regions 402. The overlap regions 402 enable the print from overlapped printheads 300 to be stitched together without a visible seam through the use of appropriate stitching algorithms that are known in the art. As described earlier, a rollers 310 (FIG. 3) is aligned with a respective print line of each row of printheads to prevent the print media from fluttering at each of the print lines 400.

Figure 5:
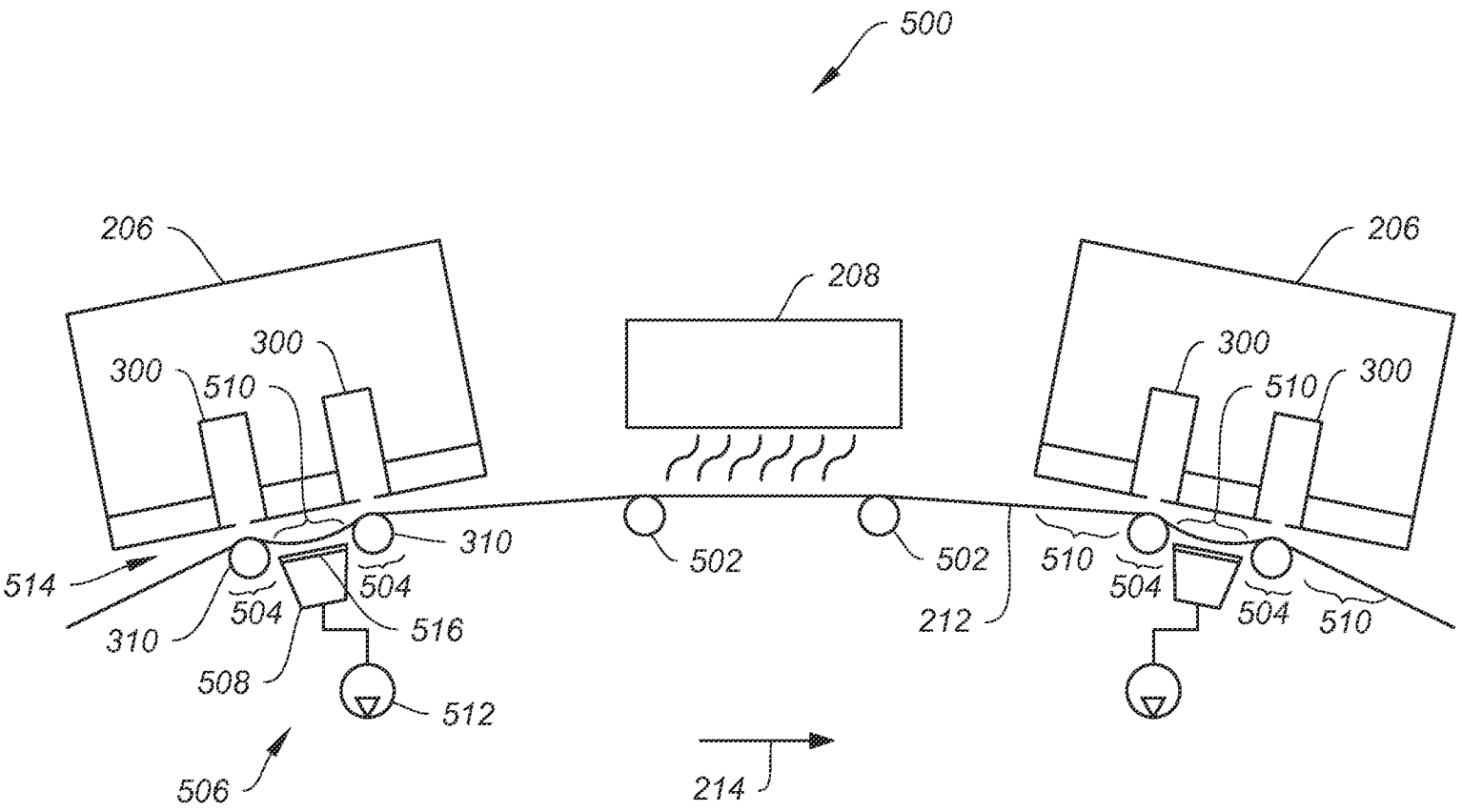
FIG. 5 is a schematic side view of a portion of a first printing system in an embodiment in accordance with the invention.

FIG. 5 is a schematic side view of a portion of a first printing system in an embodiment in accordance with the invention. The lineheads 206 and the dryer 208 are positioned opposite a first side of the print media 212. The print media 212 is guided as it passes through the printing system 500 by a number of rollers 310, 502. As the print media 212 is guided past the lineheads 206 and dryer 208, the rollers are arranged along an arc so that the print media is held in tension against each of the rollers 310, 502. In the illustrated embodiment, each linehead 206 has two rows of printheads 300 and a roller 310 is disposed under the print media 212 in a print zone 504 of each linehead 206. Each print zone 504 corresponds to a print line 400 (FIG. 4) of a linehead 206. Other embodiments in accordance with the invention are not limited to this configuration.

A vacuum assembly 506 having a vacuum manifold 508 is located between the rollers 310 located at the print zones 504 of a linehead 206 in the illustrated embodiment. The vacuum manifold 508 is positioned opposite a second side of the print media 212 and is not aligned with the print zone or zones 504 of a linehead 206. Instead, the vacuum manifold 508 is aligned with a non-print zone 510. The vacuum manifold 508 is positioned laterally adjacent to one or more print zones of a linehead. For example, in the illustrated embodiment, the vacuum manifold 508 is laterally adjacent to and positioned between the print zones 504 of the linehead 206.

The vacuum assembly 506 also includes a vacuum source 512 that is fluidically coupled to the vacuum manifold 508. In some embodiments, a single vacuum source can be used to provide a vacuum force to multiple vacuum manifolds located along the transport path of the print media. Additionally, in some embodiments, the vacuum source can be located remotely from the printing system, such as a house vacuum system, with is connected to the one or more vacuum manifolds of the printing system by means of vacuum ducts.

When a vacuum force is output by the vacuum manifold 508 during printing, the vacuum force acts on the print media 212 between the rollers 310 and pulls the print media 212 towards the manifold 508. The amount of vacuum force applied by to the print media can be based on particular print job characteristics. The print job characteristics include, but are not limited to, a weight of the moving print media and a content density of the content to be printed on the moving print media.

Pulling the print media 212 towards the manifold 508 bows the print media downward, away from the linehead 206 between the rollers and increases the wrap angle of the print media around the rollers 310. The bowing of the print media 212 away from the linehead 206 provides additional clearance gap 514 between the linehead and the print media, which can reduce the risk of flutes in the print media contacting the bottom face of the linehead.

Figure 6:
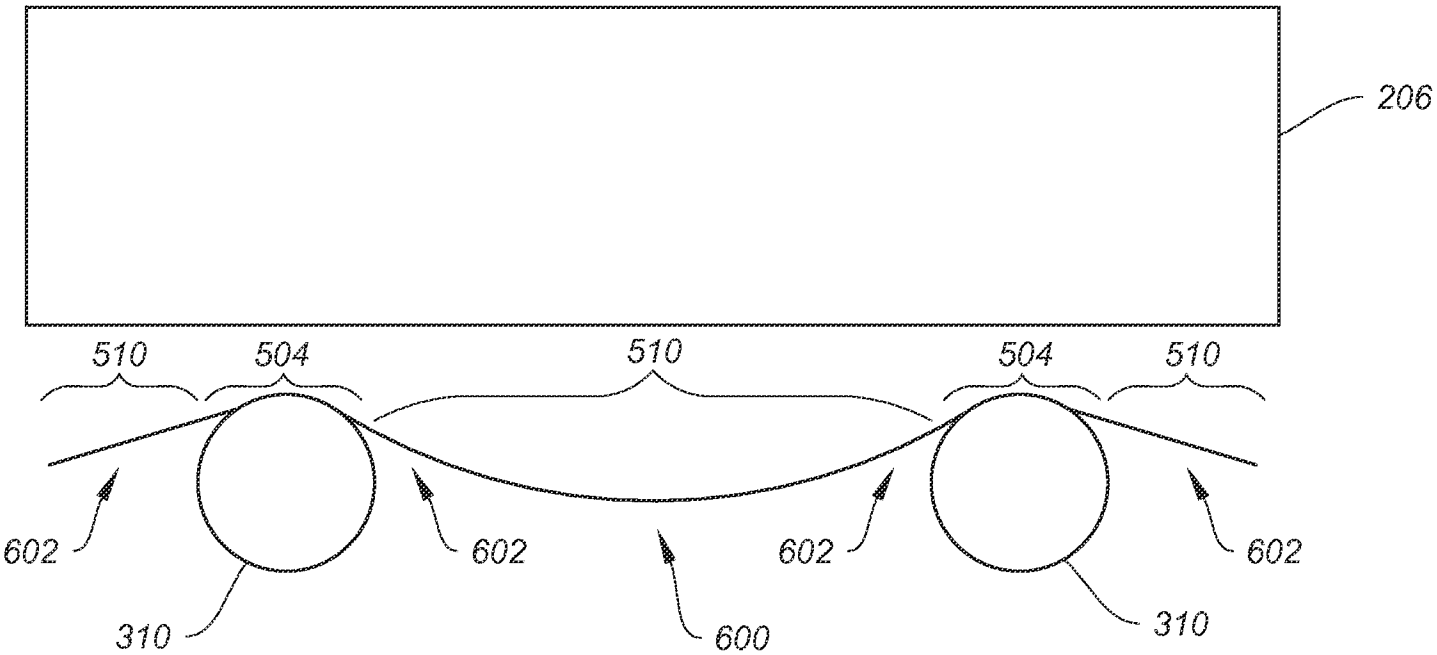
FIG. 6 depicts the print media 212 and rollers 308 shown in FIG. 5 in more detail.

The bowing of the print media 212 away from the linehead 206 produces a region of upward curvature 600 between the rollers (see FIG. 6). The wrap of the print media 212 around the rollers 310 creates regions of downward curvature 602 on both sides of the region of upward curvature 600 between the rollers 310. This combination of the increased downward curvature 602 of the print media around the rollers 310 as well as the upward curvature 600 of the print media between the rollers 310 has the effect of increasing the effective stiffness of the print media 212 in the crosstrack direction between the rollers 310. The increased crosstrack stiffness reduces the tendency of the print media to develop flutes and also assists in reducing the size of any flutes that develop. As a result, the vacuum force applied between the rollers 310 by the vacuum manifold 508 reduces the tendency of the print media 212 to contact the bottom face of the printheads 302 or of the bottom face of the support structure 304.

In one or more embodiments, the flow of air into the vacuum manifold 508 is reduced to lower the demands on the vacuum source. Accordingly, the effective width of the vacuum manifold 508 is adjustable to correspond to the width of the print media. The amount of air that can enter the vacuum manifold 508 through the gap between the walls and the print media is limited, in particular between the long upstream and downstream walls of the manifold and the print media.

Figure 7:
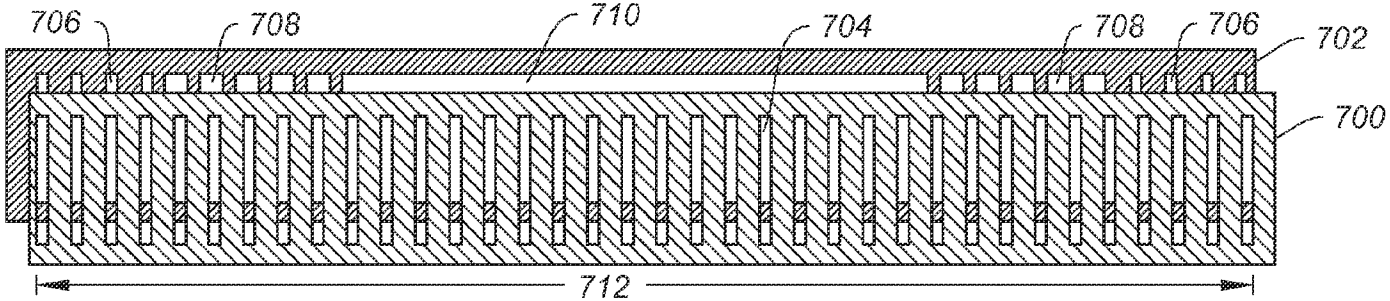
FIGS. 7-9 illustrate one example of an adjustment structure for a vacuum manifold in an embodiment in accordance with the invention.
Figure 8:
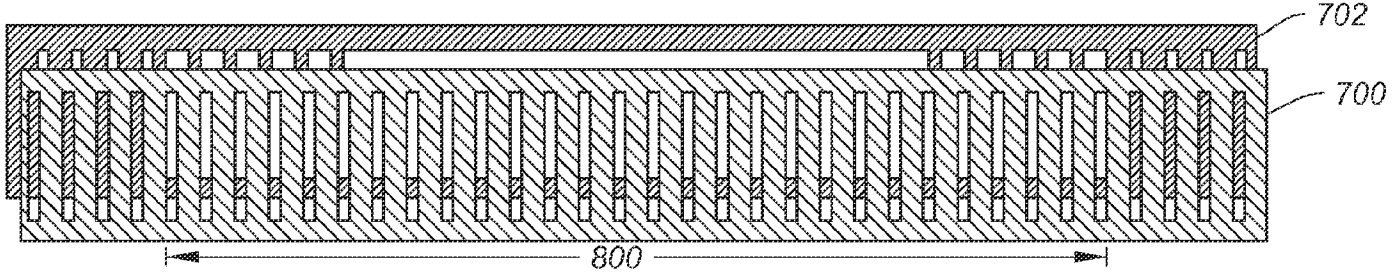
Figure 9:
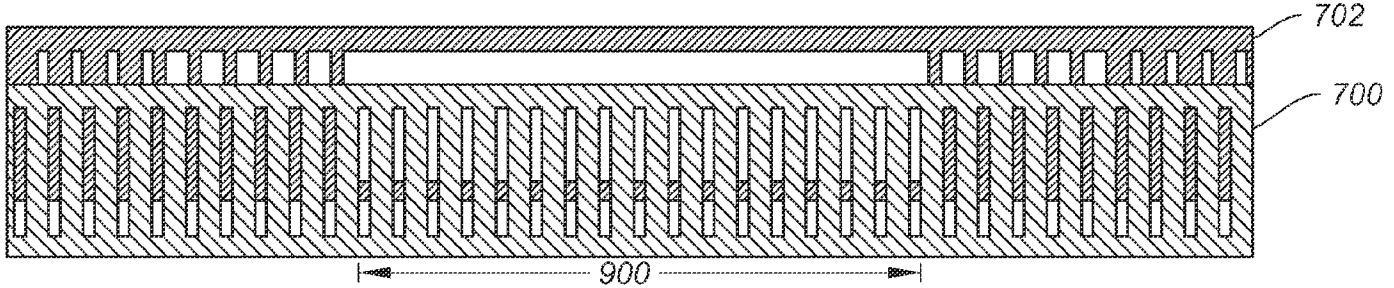

To adjust the effective width of the vacuum manifold 508 so that the effective width corresponds to the width of the print media, the vacuum assembly 506 can include an adjustment structure (see 516 in FIG. 5). The vacuum manifold 508 can include the adjustment structure 516 or the adjustment structure 516 can be disposed above the vacuum manifold 508. FIGS. 7-9 illustrate one example of an adjustment structure for a vacuum manifold in an embodiment in accordance with the invention. In the illustrated embodiment, the adjustment structure includes a sliding cover 700 in combination with a fixed cover 702. The sliding cover 700 has been displaced downward from the intended position in FIGS. 7-9 to enable a portion of the structure of the underlying fixed cover 702 to be visible. The sliding cover 700 includes a first array of apertures 704 formed through the sliding cover 700. The apertures in the first array of apertures 704 are evenly spaced down the length of the sliding cover 700 and are of a uniform size. The center to center spacing of the apertures in the first array of apertures 704 is three times the width of the apertures 704 in an embodiment in accordance with the invention.

At each end of the fixed cover 702 is a second array of apertures 706. The second array of apertures 706 has the same size and spacing as the apertures in the first array of apertures 704. The second array of apertures 706 extend down only a portion of the length of the fixed cover 702 in the illustrated embodiment.

Inboard of the second array of apertures 706 at each end of the fixed cover 702 is a third array of apertures 708. The center to center spacing of the apertures in the third array of apertures 708 is the same as the spacing for the apertures in the second array of apertures 706. But the apertures in the third array of apertures 708 each have twice the width of the apertures in the second array of apertures 706 in an embodiment in accordance with the invention.

The center portion of the fixed cover 702 includes a single aperture 710. When the sliding cover 700 is positioned laterally in a first position relative to the fixed cover 702, as depicted in FIG. 7, the apertures in the first array of apertures 704 in the sliding cover 700 align with the single aperture 710 and with the apertures in the second and third array of apertures 706, 708 in the fixed cover 702. The first position of the sliding cover relative to the fixed cover allows air to be drawn into the vacuum manifold across width 712. Air is drawn through substantially all of the apertures 704 in the sliding cover 700.

Shifting the sliding cover 700 laterally to a second position shown in FIG. 8 causes the apertures in the first array of apertures 704 in the sliding cover 700 to be aligned only with the single aperture 710 and with the apertures in the third array of apertures 708. The apertures in the first array of apertures do not align with the apertures in the second array of apertures 706 in the fixed cover 702. Air is drawn into the vacuum manifold through the portion of the apertures 704 in the sliding cover 700 across width 800. The size of width 800 is smaller than the size of width 712, so less air is drawn into the vacuum manifold.

Finally, when the sliding cover 700 is positioned laterally in a third position with respect to the fixed cover 702, as shown in FIG. 9, the apertures in the first array of apertures 704 in the sliding cover 700 align only with the single aperture 710 of the fixed cover 702. The third position allows air to be drawn into the vacuum manifold across width 900. Air is drawn through the portion of the apertures in the first array of apertures 704 that align with the single aperture in the fixed cover 702. The size of width 900 is smaller than the size of width 800 and width 712, so less air is drawn into the vacuum manifold.

The sliding cover 700 can be positioned at more than three positions with respect to the fixed cover in embodiments in accordance with the invention. The combination of the sliding cover 700 and the fixed cover 702 provides a mechanism for adjusting the effective width of the vacuum manifold to different widths. The adjustable effective width allows a vacuum force to be applied uniformly across different widths of print media. When the sliding cover is positioned at the first position (see FIG. 7) the system can apply a vacuum force uniformly across a wider width of print media. When the sliding cover is positioned at the second or third position (see FIGS. 8 and 9), the system can apply a vacuum force uniformly across narrower widths of print media. The smaller effective widths provided by the combination of the sliding and fixed covers can avoid ineffective air draw around the side of narrower print media when the sliding cover 700 is positioned in the second or third positions.

In one embodiment, the sliding cover and the fixed cover are made of a material, or coated with a material, that is non-wetting to the inks used in the printing system. By way of example only, the materials are selected to be hydrophobic for water based inks. The non-wetting nature of the materials inhibits ink from wicking into the gap that separates the fixed and sliding covers, where the ink could dry and inhibit the sliding of the sliding cover.

In some embodiments, the spacing between the vacuum manifold and the print media is adjustable to accommodate different types of print media. In some embodiments, the vacuum source is adjustable to accommodate different types of print media. For example the vacuum source can be adjusted to provide a stronger vacuum force for use with thicker substrates than are used for thinner substrates. And an adjustment structure in other embodiments in accordance with the invention is not limited to the combination of a fixed cover and a sliding cover. Any mechanism that allows for adjusting the effective width of the vacuum manifold can be used in other embodiments in accordance with the invention. For example, a manifold that includes end walls that are moveable to allow the length of the vacuum manifold to be adjusted can be used. In this embodiment, seals can be used to prevent air from leaking around the moveable end walls and the non-moveable side and bottom walls of the manifold. The vacuum manifold can also include one or more actuators for adjusting the spacing between the end walls.

In another embodiment, the side walls of the manifold include an array of grooves into which the end walls can be positioned. When a different width of print media is to be used, the effective width of the vacuum manifold in the crosstrack direction is adjusted by manually shifting the end walls from one set of grooves to another. Additionally, the width of the manifold can be adjustable from one side of the media transport. On a printing system in which the print media is center justified on the rollers, a single adjustment device should adjust both end walls of the vacuum manifold at the same time. By way of example only, the end walls are each moved by a lead screw in which the thread rotation is reversed from one side of the centerline to the other, such that a rotation of the lead screw causes end plate to move either both toward the center of the manifold or both away from the center of the vacuum manifold depending of the direction of rotation of the lead screw. The two end caps can be solid members that ride against a solid lower vacuum chamber plate that extending inward and sealed against the outside edges of the plenum. By clamping down the movable end caps against the lower base the area of the vacuum manifold, air leakage past the end walls can be eliminated.

Figure 10:
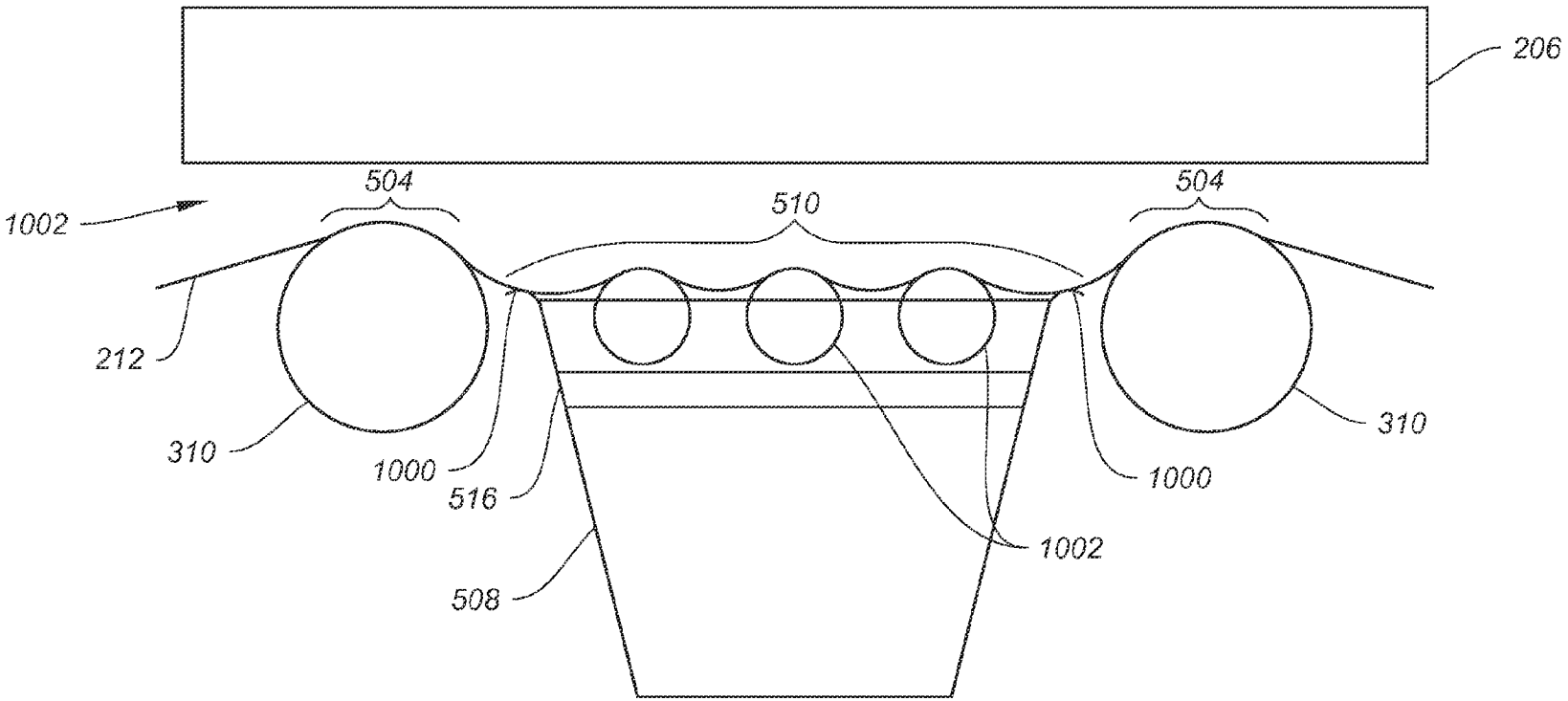
FIG. 10 is a schematic side view of a portion of a second printing system that includes a vacuum assembly in an embodiment in accordance with the invention.

FIG. 10 is a schematic side view of a portion of a second printing system that includes a vacuum assembly in an embodiment in accordance with the invention. For simplicity, only the vacuum manifold 508 and an adjustment structure 516 of the vacuum assembly are shown in the figure. In the illustrated embodiment, skid pads 1000 are formed on or attached to the upstream and downstream walls of the vacuum manifold 508. The skid pads 1000 are positioned to serve as support surfaces for the print media. The print media 212 slides across the skid pads 1000 once the print media is pulled down by the vacuum in the vacuum manifold 508. By so doing, the skid pads provide an air seal between the upstream and the downstream walls of the vacuum manifold 508 and the print media 212, to limit the amount of air drawn into the vacuum manifold. In one embodiment in accordance with the invention, the skid pads 1000 are formed of, or coated with, a material that has a low coefficient of friction and a high abrasion resistance. One such material is ultra-high-molecular-weight polyethylene. The skid pads 1000 can be formed as curved plate or sheets or can be in the form of non-rotating rods over which the print media slides.

One or more guide surfaces 1002 span the print media 212 across the opening of the vacuum manifold 508. Examples of guide surfaces 1002 include, but are not limited to, rollers, non-rotating rods or curved sheet metal surfaces. The guide surfaces 1002 are recessed below the plane or level defined by the contact of the print media 212 with the top of the two rollers 310. The print media 212 slides over the guide surfaces 1002 when the print media is pulled down by the vacuum force in the vacuum manifold. The guide surfaces 1002 help to stabilize the print media 212 as it is pulled away from the printhead by the vacuum force. By stabilizing the print media 212 in the non-print zone 510, the guide surfaces 1002 enable a more consistent print media path length between the print zones 504 of the linehead 206. This produces more consistent registration of the ink or liquid deposited on the print media 212 in the upstream print zone 504 with the ink or liquid deposited on the print media in the downstream print zone 504 of the linehead.

Other embodiments in accordance with the invention can include any number of skid pads. Additionally, the skid pads do not have to be formed on or attached to the walls of the vacuum manifold 508. The side pads can be positioned in the non-print zone 510 between the walls of the vacuum manifold 508 and the rollers 310.

Figure 11:
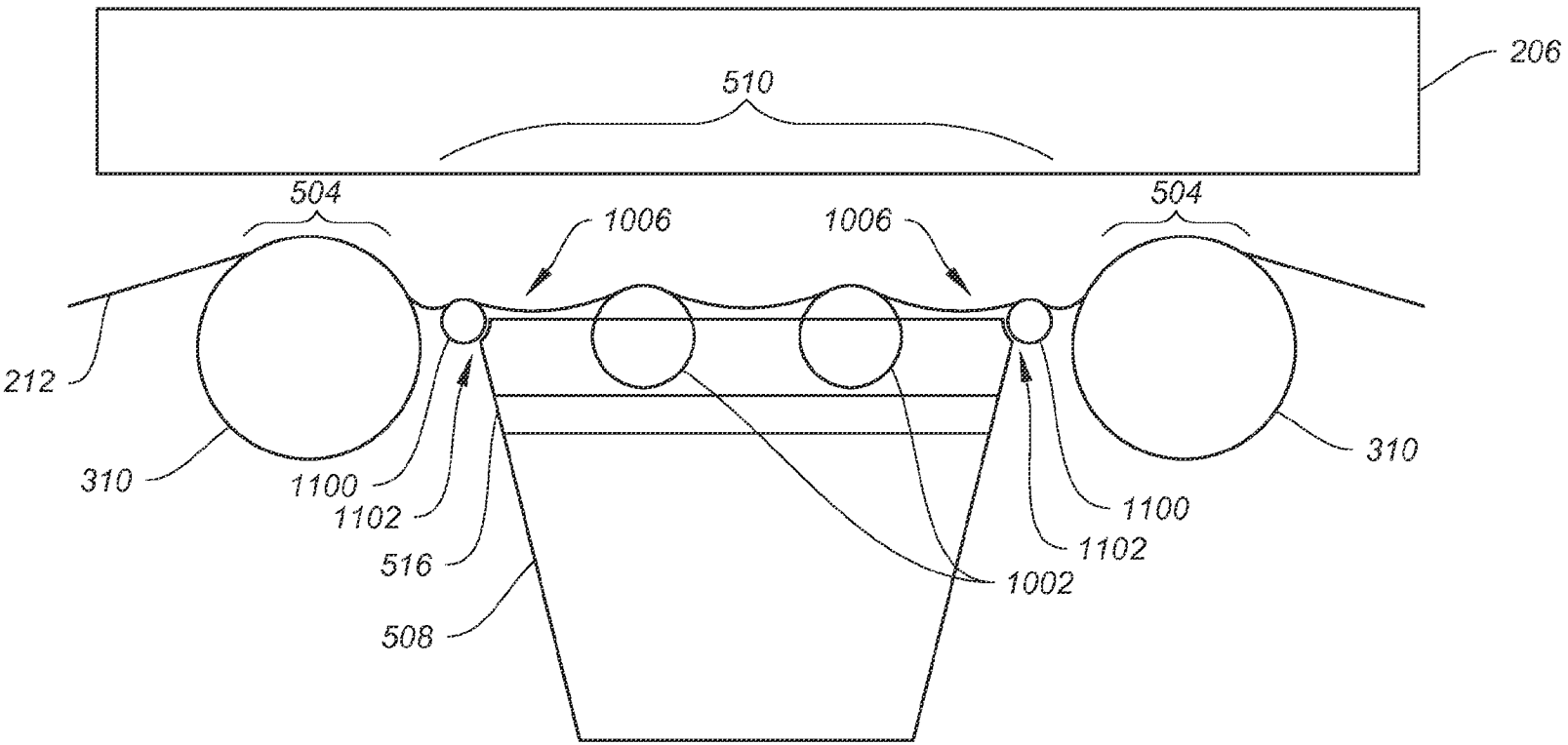
FIG. 11 is a schematic side view of a portion of a third printing system that includes a vacuum assembly in an embodiment in accordance with the invention.

Referring now to FIG. 11, there is shown a schematic side view of a portion of a third printing system that includes a vacuum assembly in an embodiment in accordance with the invention. For simplicity, only a vacuum manifold 508 and an adjustment structure 516 of the vacuum assembly is shown in the figure. In this embodiment, the support surfaces for limiting the flow of air into the vacuum manifold comprise sealing rollers 1100 that are positioned laterally adjacent to the vacuum manifold 508. The sealing rollers 1100 are positioned in the non-print zone 510 and are recessed below the plane or level defined by the contact of the print media 212 with the top of the two rollers 310. The sealing rollers 1100 support the print media 212 to create an air seal between the sealing rollers 1100 and the print media 212. As the sealing rollers 1100 can rotate as the print media moves over each sealing roller, the surface speed of the sealing rollers matches that the speed of the print media. As a result, there can be less risk of print media being scuffed by the sealing rollers 1100 than in embodiments that use the skid pads 1000.

In the embodiment of FIG. 11, there is an extended airflow gap 1102 between the wall of the vacuum manifold 508 and the sealing rollers 1100. The presence of the airflow gap 1102 between the vacuum manifold 508 and the sealing rollers 1100 allows the sealing rollers 1100 to rotate freely as the print media 212 moves over the sealing rollers 1100. By extending the airflow gap 1102, so that the gap extends along a considerable portion of the circumference of the sealing rollers 1100, the flow impedance to airflow through that gap is sufficiently high that airflow into the vacuum manifold 508 can be maintained at acceptable levels. By way of example only, in one embodiment, the extended airflow gap 1102 wraps around approximately ¼ of the circumference of the sealing rollers 1100.

Figure 12:
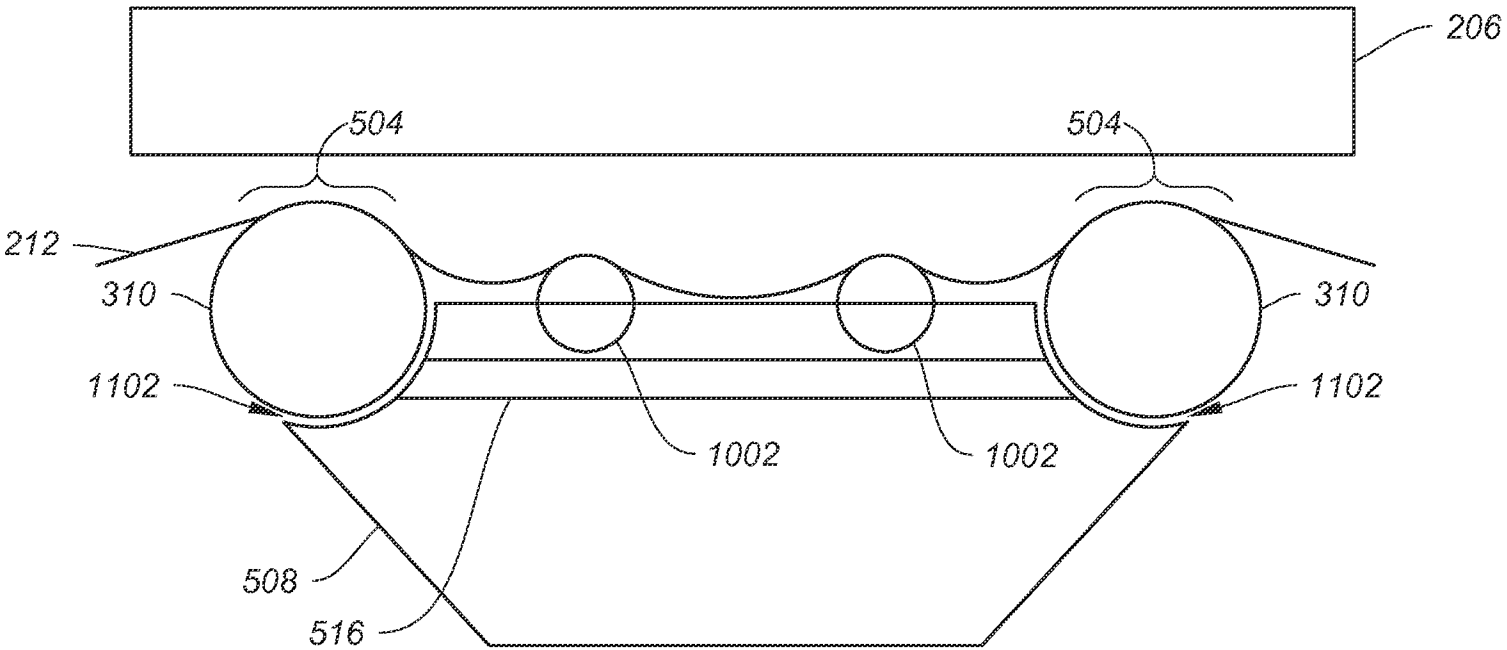
FIG. 12 is a schematic side view of a portion of a fourth printing system that includes a vacuum assembly in an embodiment in accordance with the invention.

FIG. 12 is a schematic side view of a portion of a fourth printing system that includes a vacuum assembly in an embodiment in accordance with the invention. For simplicity, only a vacuum manifold 508 and an adjustment structure 516 of the vacuum assembly is shown in the figure. In this embodiment, the support surfaces for limiting the flow of air into the vacuum manifold 508 comprise the rollers 310 aligned with the print lines of each row of printheads. The rollers 310 prevent the print media 212 from fluttering, or vibrating up and down in the print zone 504 of each linehead 206. As the print media 212 firmly contacts the rollers 310, no air flows between the print media 212 and the rollers 310 to flow into the vacuum manifold 508. As in the embodiment of FIG. 11, the airflow gap 1102 between the wall of the vacuum manifold 508 and the roller 310 allows the roller 310 to freely rotate. The airflow gap 1102 is extended along a considerable portion of the circumference of the rollers 310, making the flow impedance to airflow through that gap sufficiently high that airflow into the vacuum manifold can be maintained at acceptable levels.

Figure 13:
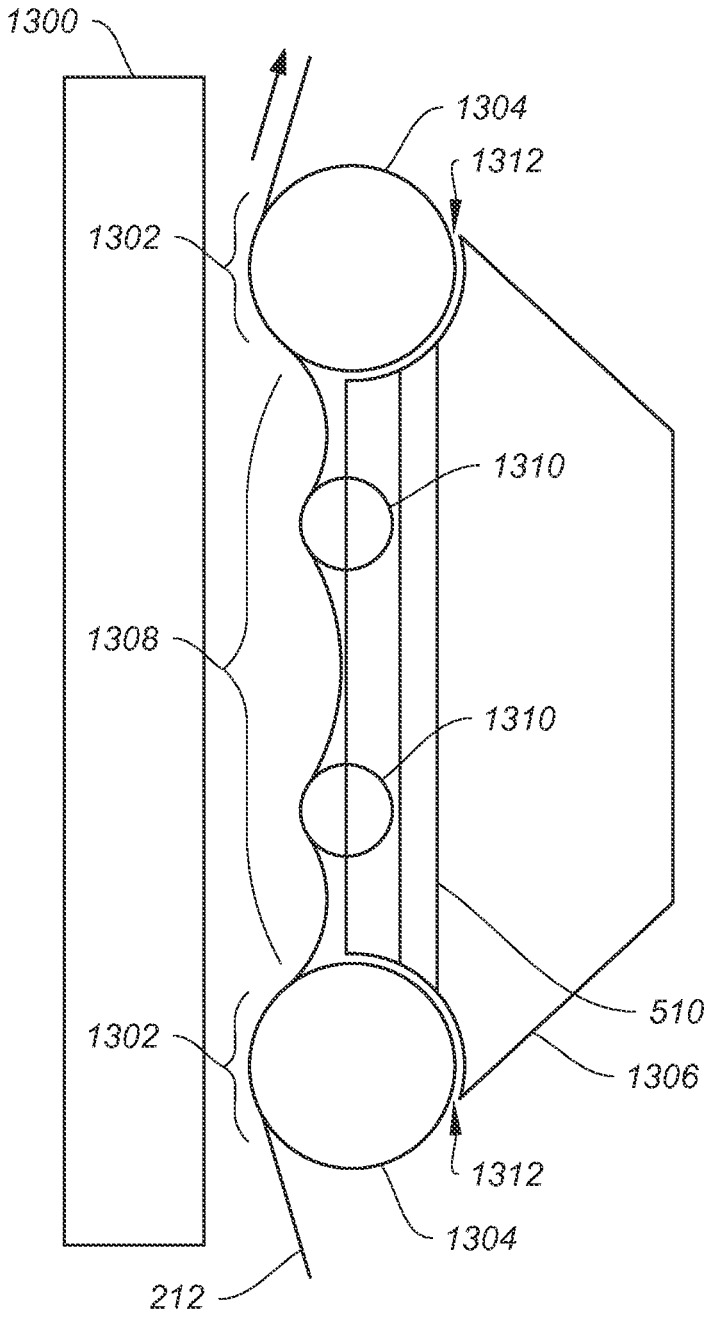
FIG. 13 is a schematic side view of a portion of a fifth printing system that includes a vacuum assembly in an embodiment in accordance with the invention.

While the embodiments shown in FIGS. 10-12 have the linehead 206 oriented above the print media 212, the invention is not limited to that orientation. In FIG. 13, the print media 212 is being moved vertically opposite a linehead 1300. The linehead has two print zones 1302 in which ink drops are jetted horizontally onto the print media. Rollers 1304 guide the print media, providing a lateral constraint or support to the print media 212 so that the spacing of the print media 212 relative to the linehead 1300 is well defined in the print zones 1302. The linehead 1300 is located on one side of the print media, called a first side of the print media, and the vacuum assembly is located on the opposite side of the print media from the linehead 1300, referred to as a second side of the print media.

The vacuum manifold 1306 of the vacuum assembly is located in a non-print zone 1308 between the print zones 1302. The vacuum manifold 1306 has an opening opposite a portion of the second side of the print media 212 so that the vacuum force in the vacuum manifold 1306 can act on this portion of the print media. The vacuum force acts on the print media to cause at least a portion of the print media 212 to be deflected away from the linehead 1300. The rollers 1304, which are aligned with the print zones 1302, act to limit the size of the opening in the vacuum manifold 1306 so that the opening does not extend into the print zone 1302. The portion of the print media in the print zone 1302 is therefore not deflected by the vacuum force. The vacuum assembly also includes guide surfaces 1310 which support or constrain the print media so that the print media 212 is not pulled into the vacuum manifold 1306 to an excessive depth.

As in the embodiment of FIGS. 11 and 12, an airflow gap 1312 between the walls of the vacuum manifold 1306 and the rollers 1304 allows the rollers 1304 to rotate freely. The airflow gap 1312 is extended along a considerable portion of the circumference of the rollers 1304, making the flow impedance to airflow through that the airflow gap 1312 sufficiently high that airflow into the vacuum manifold can be maintained at acceptable levels.

Figure 14:
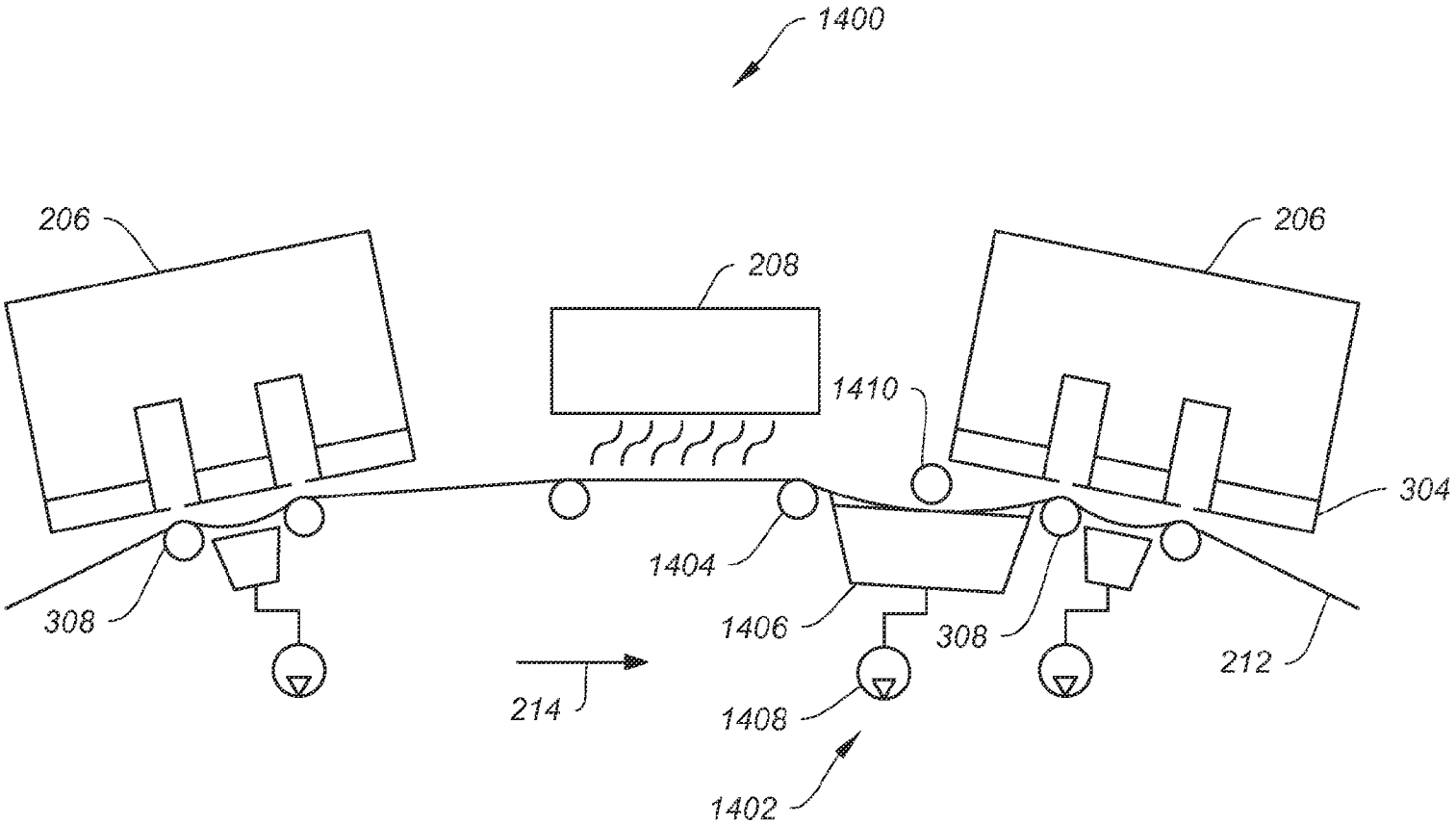
FIG. 14 is a schematic side view of a portion of a sixth printing system in an embodiment in accordance with the invention.

FIG. 14 is a schematic side view of a portion of a sixth printing system in an embodiment in accordance with the invention. In this printing system 1400, another vacuum assembly 1402 is located adjacent to the second side of the print media 212 between the roller 310 and a roller 1404 supporting the print media 212 at a position remote from the linehead, such as where the print media passes another component. In the illustrated embodiment, the second vacuum assembly 1402 is located between dryer 208 and the second linehead 206. The vacuum force applied by the vacuum assembly 1402 serves to deflect the print media 212 between the rollers 1404, 310 away from the support structure 304 of the linehead 206. In the illustrated embodiment, the vacuum assembly 1402 includes a vacuum manifold 1406 and a vacuum source 1408.

Located above the vacuum manifold 1406 on the first side of the print media from the vacuum manifold is a roller 1410. When a vacuum force is applied to the vacuum manifold 1406, the vacuum force deflects the print media, pulling the print media away from the roller 1410. When the vacuum force is deactivated, the print media contacts roller 1410. The roller 1410 deflects the print media down relative to that path that the print media would have taken between the rollers 1404 and 310. By so doing, the roller 1410 locates a portion of the print media close enough to the vacuum manifold so that the vacuum force can act effectively on the print media to further deflect the print media.

Although not shown in FIG. 14, the vacuum assembly 1402 can also include guide surfaces, skid pads, or an adjustment structure, such as the guide surfaces, skid pads, sealing rollers, and adjustment structure shown in FIGS. 5 and 10-13. Such guide surfaces, skid pads, sealing rollers and adjustment structures serve a similar function as described in conjunction with FIGS. 5 and 10-13. FIG. 14 illustrates the vacuum assembly 1402 as a vacuum assembly that is used in addition to the vacuum assemblies located between the print zones of the linehead, at a second location along the media path. There are applications in which single vacuum assembly is used where the vacuum assembly is disposed along the media path in the manner illustrated by vacuum manifold 1402. The linehead 206 is disposed opposite a first side of a print media 212, the linehead having one or more print zones where a liquid is deposited onto the first side of the print media. The vacuum assembly 1402 is disposed opposite the second side of the print media, where the vacuum assembly 1402 is aligned with a non-print zone 510 of the linehead and produces a vacuum force proximate to the second side of the print media such that at least a portion of the second side of the print media is deflected away from the linehead. The vacuum assembly 1402 is disposed opposite the second side of the print media between one roller disposed opposite the linehead and another roller disposed one the second side of the print media opposite the component without another vacuum assembly being located between the print zones of the linehead.

The invention has been described in detail with particular reference to certain preferred embodiments thereof, but it will be understood that variations and modifications can be effected within the spirit and scope of the invention. And even though specific embodiments of the invention have been described herein, it should be noted that the application is not limited to these embodiments. In particular, any features described with respect to one embodiment may also be used in other embodiments, where compatible. The features of the different embodiments may be exchanged, where compatible.

1. A printing system can include a linehead disposed opposite a first side of a print media and a first vacuum assembly having a vacuum manifold disposed opposite a second side of the print media. The linehead includes one or more print zones where a liquid or ink is deposited onto the first side of the print media. The vacuum manifold of the first vacuum assembly is aligned with a non-print zone-of the linehead and outputs a vacuum force proximate to the second side of the print media such that at least a portion of the second side of the print media is deflected away from the linehead.

2. The printing system as in clause 1, where the first vacuum assembly comprises the vacuum manifold and a vacuum source.

3. The printing system as in clause 1 or clause 2, where the first vacuum assembly further comprises an adjustment structure adjacent to the second side of the print media for adjusting an effective width of the vacuum manifold.

4. The printing system as in clause 3, where the adjustment structure includes a fixed cover having an array of apertures of varying dimensions and a sliding cover disposed adjacent to the fixed cover having an array of apertures with each aperture having a common fixed dimension.

5. The printing system as in clause 3, where the adjustment structure includes at least one movable end wall of the vacuum manifold to adjust the effective width of the vacuum manifold.

6. The printing system as in clause 5, where the at least one movable end wall comprises two movable end walls. The adjustment structure can further include a single adjustment device for simultaneously adjusting the position of the two movable end walls of the vacuum manifold.

7. The printing system as in any one of clauses 1-6, where the print media is a continuous web of print media.

8. The printing system as in any one of clauses 1-7, where the vacuum manifold includes one or more guide surfaces.

9. The printing system in any one of clauses 1-8 can include rollers disposed opposite the linehead and adjacent to the second side of the print media with at least one roller aligned with a respective print zone of the linehead.

10. The printing system in any one of clauses 1-9 can include skid pads disposed opposite the linehead and adjacent to the second side of the print media and laterally adjacent to the vacuum manifold.

11. The printing system in any one of clauses 1-10 can include sealing rollers disposed adjacent to the second side of the print media and laterally adjacent to the vacuum manifold.

12. The printing system in clause 9 or clause 11 can include an extended airflow gap between each support surface and the vacuum manifold.

13. The printing system in any one of clauses 1-12 can include a component disposed opposite the first side of the print media and laterally adjacent to the linehead.

14. The printing system as in clause 13, where the component includes a dryer.

15. The printing system in clause 13 or clause 14 can include a second vacuum assembly having a vacuum manifold disposed opposite the second side of the print media between one roller disposed opposite the linehead and another roller disposed opposite the component.

16. The printing system as in clause 15, where the second vacuum assembly includes a vacuum source.

17. The printing system as in clause 15 or clause 16, where the second vacuum assembly includes an adjustment structure adjacent to the second side of the print media for adjusting an effective width of the vacuum manifold of the second vacuum assembly.

18. The printing system as in clause 17, where the adjustment structure includes a fixed cover having an array of apertures of varying dimensions, and a sliding cover disposed adjacent to the fixed cover having an array of apertures with each aperture having a common fixed dimension.

19. The printing system in any one of clauses 15-18 can include wherein the vacuum manifold of the second vacuum assembly includes one or more guide surfaces.

20. The printing system in any one of clauses 15-19 can include skid pads disposed adjacent to the second side of the print media and laterally adjacent to the vacuum manifold of the second vacuum assembly.

21. A method for printing on a moving print media in a printing system that includes one or more lineheads with each linehead having one or more print zones that deposit a liquid or ink on a first side of the print media and a vacuum manifold of a vacuum assembly is disposed opposite a second side of the print media opposite at least one linehead, where the vacuum manifold is aligned with a non-print zone of the at least one linehead, can include moving the print media through the printing system, and applying a first vacuum force proximate to the second side of the print media opposite the at least one linehead based on at least one print job characteristic. The print job characteristics can include a weight of the moving print media and a content density of the content to be printed on the moving print media.

22. The method in clause 21 can include adjusting an effective width of the vacuum manifold with an adjustment structure positioned between the vacuum manifold and the second side of the print media.

23. The method in clause 21 or clause 22 can include sliding the print media over skid pads positioned laterally adjacent to the vacuum manifold while the first vacuum force is applied to the second side of the print media.

24. The method in any one of clauses 21-23 can include sliding the print media over guide surfaces positioned within the vacuum manifold while the first vacuum force is applied to the second side of the print media.

25. The method in any one of clauses 21-24 can include sliding the print media over sealing rollers positioned laterally adjacent to the vacuum manifold while the first vacuum force is applied to the second side of the print media.

26. The method in any one of clauses 21-25 can include applying a second vacuum force proximate to the second side of the print media between one linehead and another component disposed opposite the first side of the print media and laterally adjacent to the linehead.

PARTS LIST

100 in-track direction
102 crosstrack direction
104 flute
106 flute
108 roller
110 roller
200 printing system
202 module
204 module
206 linehead
208 dryer
210 quality control sensor
212 print media
214 feed direction
216 turnover module
300 printhead
302 nozzle array
304 support structure
306 heat
308 clearance gap
310 roller
400 print line
402 overlap region
500 printing system
502 roller
504 print zone
506 vacuum assembly
508 vacuum manifold
510 non-print zone
512 vacuum source
514 clearance gap
516 adjustment structure
600 region of upward curvature
602 region of downward curvature
700 sliding cover
702 fixed cover
704 aperture
706 aperture
708 aperture
710 single aperture
712 width
800 width
900 width
1000 skid pads
1002 guide surface
1100 sealing roller
1102 extended airflow gap
1300 linehead
1302 print zone
1304 roller
1306 vacuum manifold
1308 non-print zone
1310 guide surface
1312 extended airflow gap
1400 printing system
1402 vacuum assembly
1404 roller
1406 vacuum manifold
1408 vacuum source
1410 roller

The invention claimed is:

1. A method for printing on a moving print media in a printing system that includes one or more lineheads with each linehead having one or more print zones that deposit a liquid on a first side of the print media, a vacuum assembly having a vacuum manifold disposed opposite a second side of the print media opposite at least one linehead, wherein the vacuum manifold of the vacuum assembly is aligned with a non-print zone of the at least one linehead, the method comprising:

moving the print media through the printing system, wherein the print media is a continuous web of print media;

applying a first vacuum force proximate to the second side of the print media opposite the at least one linehead and only in the non-print zone based on at least one print job characteristic such that the print media is deflected away from the linehead when the print media is in the non-print zone;

providing one or more rollers disposed opposite the linehead and adjacent to the second side of the print media with at least one roller aligned with a print zone of the linehead; and using the aligned roller to support the print media in the print zone.

2. The method as in claim 1, wherein the at least one print job characteristic includes at least one of a weight of the moving print media and a content density of the content to be printed on the moving print media.

3. The method as in claim 1, further comprising adjusting the effective width of the vacuum manifold with an adjustment structure positioned between the vacuum manifold and the second side of the print media.

4. The method as in claim 1, further comprising sliding the print media over skid pads positioned laterally adjacent to the vacuum manifold while the first vacuum force is applied to the second side of the print media.

5. The method as in claim 1, further comprising sliding the print media over guide surfaces positioned within the vacuum manifold while the first vacuum force is applied to the second side of the print media.

6. The method as in claim 1, further comprising sliding the print media over sealing rollers positioned laterally adjacent to the vacuum manifold while the first vacuum force is applied to the second side of the print media.

7. The method as in claim 1, further comprising applying a second vacuum force proximate to the second side of the print media between one linehead and another component disposed opposite the first side of the print media and laterally adjacent to the linehead.

* * * * *